United States Patent [19]

Jin

[11] 4,419,148

[45] Dec. 6, 1983

[54] HIGH-REMANENCE FE-NI AND FE-NI-MN ALLOYS FOR MAGNETICALLY ACTUATED DEVICES

[75] Inventor: Sungho Jin, Gillette, N.J.

[73] Assignee: Bell Telephone Laboratories, Incorporated, Murray Hill, N.J.

[21] Appl. No.: 351,512

[22] Filed: Feb. 23, 1982

Related U.S. Application Data

[62] Division of Ser. No. 142,634, Apr. 22, 1980, abandoned.

[51] Int. Cl.[3] ..... H01F 1/00

[52] U.S. Cl. ..... 148/120; 148/12 A

[58] Field of Search ..... 148/12 A, 120, 121, 148/122

[56] References Cited

U.S. PATENT DOCUMENTS

| | | | |
|---|---|---|---|
| 2,382,652 | 8/1945 | Nesbitt | 75/123 N |
| 3,348,931 | 10/1967 | Reekstin | 148/31.55 |
| 3,574,003 | 4/1971 | Nara et al. | 148/31.55 |
| 3,624,568 | 11/1971 | Olsen | 335/153 |
| 3,846,185 | 11/1974 | Nakajima et al. | 148/31.55 |
| 3,970,447 | 7/1976 | Lang | 75/123 K |
| 4,140,557 | 2/1979 | Parker et al. | 75/123 K |

OTHER PUBLICATIONS

English Language Translation of Japanese Patent Application Publication 17124 (1973); May 27, 1973.

L. R. Moskowitz, *Permanent Magnet Design and Application Handbook,* Cahners Books 1976; pp. 211–220.

M. R. Pinnel, "Magnetic Materials for Dry Reed Contacts," IEEE Tran. Mag., vol. MAG-12, No. 6, Nov. 1976, pp. 789–794.

M. Hansen, *Constitution of Binary Alloys,* 2nd ed., McGraw-Hill, 1958, pp. 677–684.

R. M. Bozorth, *Ferromagnetism,* Van Nostrand, 1951, pp. 102 to 115 and 180–182.

G. M. Fedash, "Study of Coercivity of Cold-Worked and Annealed Iron Alloys," The Physics of Metals and Metallography, vol. 4, No. 2, 1957, pp. 50–55.

S. Jin et al., "The Effect of Grain Size and Retained Austenite on the Ductile-Brittle Transition of a Titanium-Gettered Iron Alloy". Metallurgical Transactions A, vol. 6A Sep. 1975, pp. 1721–1726.

V. I. Zel'Dovich et al., "Effect of Heat Treatment on the Magnetic Properties of Certain Alloys of the Fe-Mn and Fe-Ni" Physics of Metals and Metallography, vol. 20, No. 3, 1965, pp. 87–92.

K. A. Malyshev et al., "Tempering Variations in the Physical Properties of the Martensite Ferronickel Alloys Containing Titanium" Physics of Metals and Metallography, vol. 18, No. 2, 1964, pp. 80–84.

M. Tokuyoshi, "A Study of the Semihard Magnet Alloys for Latching Reed Relays," IEEE Transactions on Magnetics, Sep. 1971, pp. 664–667.

*Primary Examiner*—John P. Sheehan

*Attorney, Agent, or Firm*—Peter A. Businger

[57] ABSTRACT

Magnetically actuated devices such as, e.g., switches and synchronizers typically comprise a magnetically semihard component having a square B-H hysteresis loop and high remanent induction. Among alloys having such properties are Co-Fe-V, Co-Fe-Nb, and Co-Fe-Ni-Al-Ti alloys which, however, contain undesirably large amounts of cobalt.

According to the invention, devices are equipped with a magnetically semihard, high-remanence Fe-Ni or Fe-Ni-Mn alloy which contains Ni in a preferred amount in the range of 6–20 weight percent and Ni in an amount which is less than or equal to 8 weight percent. Remanence $B_r$ (gauss) is greater than or equal to 15,000 gauss; squareness $B_r/B_s$ typically is greater than 0.95.

Magnets made from alloys of the invention may be shaped, e.g., by cold drawing, rolling, bending, or flattening and may be used in devices such as, e.g., electrical contact switches, hysteresis motors, and other magnetically actuated devices.

Preparation of alloys of the invention may be by a treatment of producing fine-scale, essentially isotropic, two-phase structure, subsequent uniaxial deformation, and aging to achieve a fine-scale, elongated, and aligned two-phase or multiphase structure.

8 Claims, 3 Drawing Figures

HIGH-REMANENCE FE-NI AND FE-NI-MN ALLOYS FOR MAGNETICALLY ACTUATED DEVICES

CROSS-REFERENCE TO RELATED APPLICATIONS

This is a divisional application of application Ser. No. 142,634, filed Apr. 22, 1980, now abandoned.

TECHNICAL FIELD

The invention is concerned with magnetic devices and materials.

BACKGROUND OF THE INVENTION

Magnetically actuated devices may be designed for a variety of purposes such as, e.g., electrical switching, position sensing, synchronization, flow measurement, and stirring. Particularly important among such devices are so-called reed switches as described, e.g., in the book by L. R. Moskowitz, *Permanent Magnet Design and Application Handbook,* Cahners Books, 1976, pp. 211–220, in U.S. Pat. No. 3,624,568, issued Nov. 30, 1971 to K. M. Olsen et al., and in the paper by M. R. Pinnel, "Magnetic Materials for Dry Reed Contacts", *IEEE Trans. Mag.,* Vol. MAG-12, No. 6, November 1976, pp. 789–794. Reed switches comprise flexible metallic reeds which are made of a material having semihard magnetic properties as characterized by an essentially square B-H hysteresis loop and high remanent induction $B_r$; during operation reeds bend elastically so as to make or break electrical contact in response to changes in a magnetic field.

Among established alloys having semihard magnetic properties are Co-Fe-V alloys known as Vicalloy and Remendur, Co-Fe-Nb alloys known as Nibcolloy, and Co-Fe-Ni-Al-Ti alloys known as Vacozet. These alloys possess adequate magnetic properties; however, they contain substantial amounts of cobalt whose rising cost in world markets causes concern. Moreover, high cobalt alloys tend to be brittle, i.e., to lack sufficient cold formability for shaping, e.g., by cold drawing, rolling, bending, or flattening.

Relevant with respect to the invention are the book by M. Hansen, *Constitution of Binary Alloys,* 2nd edition, McGraw-Hill, 1958, pp. 677–684; the book by R. M. Bozorth, Ferromagnetism, Van Nostrand, 1951, pp. 102–115 and pp. 180–182; the paper by G. M. Fedash, "Study of Coercivity of Cold-Worked and Annealed Iron Alloys", *The Physics of Metals and Metallography,* Vol. 4, No. 2, 1957, pp. 50–55; and the paper by S. Jin et al., "The Effect of Grain Size and Retained Austenite on the Ductile-Brittle Transition of a Titanium-Gettered Iron Alloy", *Metallurgical Transactions A,* Vol. 6A, September 1975, pp. 1721–1726. These references discuss phase transformations, mechanical properties, and coercivity of iron-rich Fe-Ni alloys. Semihard magnetic properties of Fe-Ni and Fe-Mn alloys are disclosed by V. I. Zeldovich et al., "Effect of Heat Treatment on the Magnetic Properties of Certain Alloys of the Systems Fe-Mn and Fe-Ni", *Fiz. Metal. Metalloved.,* Vol. 20, No. 3, pp. 406–411, 1965; and in Japanese patent No. 48-17124, issued May 26, 1973 to T. Takahashi et al.

SUMMARY OF THE INVENTION

According to the invention, high-remanence, semihard magnetic properties are realized in Fe-Ni and Fe-Ni-Mn alloys which comprise Fe, Ni, and Mn in a preferred combined amount of at least 98 weight percent, Ni in a preferred amount in the range of 6–20 weight percent of such combined amount, and Mn in a preferred amount of 0–8 weight percent of such combined amount. Remanent magnetic induction $B_r$(gauss) of alloys of the invention is typically greater than or equal to 15,000 gauss and, more specifically, greater than or equal to a value of $20{,}000-200\times$weight percent Ni$-400\times$weight percent Mn, and their squareness ratio $B_r/B_s$ is greater than 0.9 and typically greater than or equal to 0.95.

Alloys of the invention characteristically exhibit an anisotropic two-phase or multiphase microstructure, particles and grains being aligned and elongated to have preferred aspect ratio of at least 8 and preferably at least 30. Preferred particle diameter or thickness is less than 8000 Angstrom and preferably less than 2000 Angstrom.

Magnets made from such alloys may be shaped, e.g., by cold drawing, rolling, bending, or flattening and may be used in devices such as, e.g., electrical contact switches, hysteresis motors, and other magnetically actuated devices.

Preparation of alloys of the invention may be by a treatment of initial deformation, aging, deformation, and final aging. Aging steps are preferably carried out at temperatures at which an alloy is in a two-phase or multiphase state. Deformation steps are preferably by uniaxial deformation.

DETAILED DESCRIPTION

Figure 1:
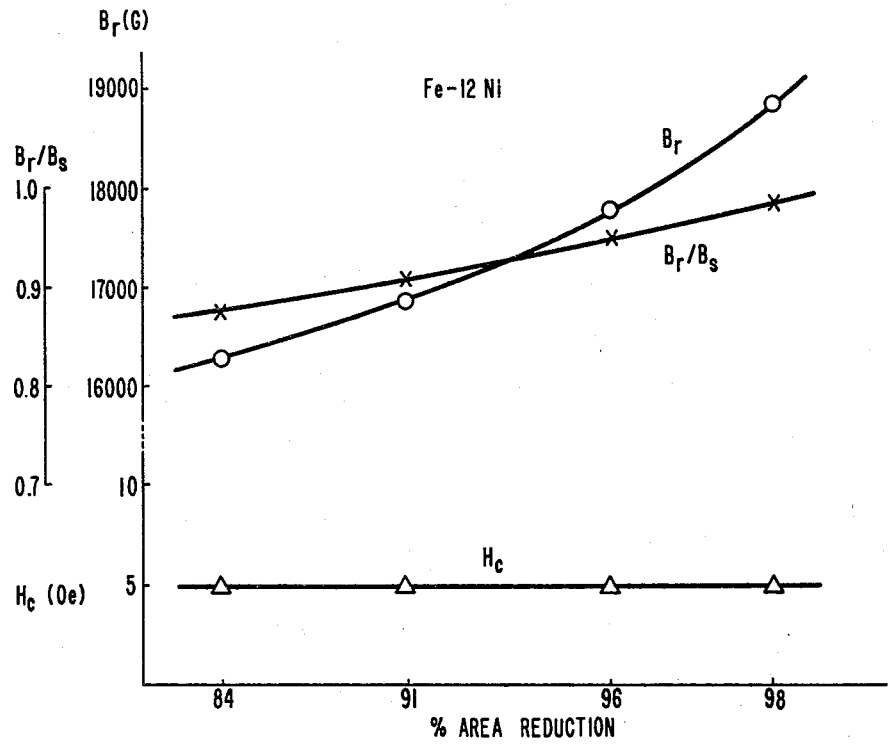
FIG. 1 shows magnetic properties of an Fe-12Ni alloy as a function of cross-sectional area reduction by wire drawing.

Semihard magnet properties may be conveniently defined by remanent magnetic induction $B_r$ greater than 7000 gauss and squareness ratio $B_r/B_s$ greater than 0.7. High-remanence, square loop, semihard magnet properties may be further defined by remanent magnetic reduction $B_r$ greater than or equal to 15,000 gauss and squareness ratio $B_r/B_s$ greater than or equal to 0.9. Alloys having such properties are suited for use in magnetically actuated devices which may be conveniently characterized in that they comprise a component whose position is dependent on strength, direction, or presence of a magnetic field and further in that they comprise means such as, e.g., an electrical contact for sensing the position of such component.

In accordance with the invention, high-remanence, semihard magnet properties are realized in Fe-Ni and Fe-Ni-Mn alloys which preferably comprise, Fe, Ni, and Mn in a combined amount of at least 98 weight percent, Ni in a preferred amount in the range of 6–20 weight percent and preferably 7–16 weight percent of such combined amount, and Mn in a preferred amount in the range of 0–8 weight percent and preferably 0–6 weight percent of such amount. The combined amount of Ni and Mn in such alloys is preferably less than or equal to 16 weight percent of the combined amount of Fe, Ni, and Mn.

Alloys of the invention may comprise small amounts of additives such as, e.g., Cr for the sake of enhanced corrosion resistance, or Co for the sake of enhanced magnetic properties; however, excessive amounts of Cr may be detrimental to magnetic properties. Other elements such as, e.g., Si, Al, Cu, Mo, V, Ti, Nb, Zr, Ta, Hf, and W may be present as impurities in individual amounts preferably less than 0.2 weight percent and in a combined amount preferably less than 1 weight percent. Similarly, elements C, N, S, P, B, H, and O are preferably kept below 0.1 weight percent individually and below 0.5 weight percent in combination. Minimization of impurities is in the interest of maintaining alloy formability for development of anisotropic structure as well as for shaping into desired form. Excessive amounts of elements mentioned may also lead to inferior magnetic properties.

Magnetic alloys of the invention possess anisotropic multiphase grain and microstructure in which particles and grains having preferred aspect ratio of at least 8 and preferably at least 30. Aspect ratio may conveniently be defined as length-to-diameter ratio when deformation is uniaxial such as, e.g., by wire drawing. Preferred particle size is less than 8000 Angstrom and preferably less than 2000 Angstrom. Submicron structure may be conveniently determined, e.g., by electron microscopy.

Remanent magnetic induction $B_r$ of alloys of the invention is approximately linearly dependent on Ni and Mn contents of alloys. Specifically, remanent magnetic induction of alloys of the invention equals or exceeds 15,000 gauss and, more specifically, a value which may be expressed by the approximate formula $B_r$(gauss)$=20{,}000-200\times$weight percent Ni$-400\times$ weight percent Mn. Squareness ratio $B_r/B_s$ of alloys of the invention is typically greater than or equal to 0.95 and magnetic coercivity is in the range of 1–200 oersted.

Alloys of the invention may be prepared, e.g., by casting from a melt of constituent elements Fe, Ni, and Mn in a crucible or furnace such as, e.g., an induction furnace; alternatively, a metallic body having a composition within the specified range may be prepared by powder metallurgy. Preparation of an alloy and, in particular, preparation by casting from a melt calls for care to guard against inclusion of excessive amounts of impurities as may originate from raw materials, from the furnace, or from the atmosphere above the melt. To minimize oxidation or excessive inclusion of nitrogen, it is desirable to prepare a melt with slag protection, in a vacuum, or in an inert atmosphere.

Cast ingots of an alloy of the invention may typically be processed by hot working, cold working, and solution annealing for purposes such as homogenization, grain refining, shaping, or the development of desirable mechanical properties.

Processing to achieve desirable anisotropic structure such as elongated grains and crystallographic texture may be carried out by various combinations of sequential processing steps. A particularly effective exemplary processing sequence comprises processing at temperatures corresponding to a two-phase region in the phase diagram by (1) initial plastic deformation, (2) initial aging, resulting in essentially two-phase decomposition, (3) final plastic deformation, and (4) final aging.

Initial plastic deformation preferably is by an amount corresponding to at least 50 percent area reduction and may be at temperatures in the range of from −196 degrees C. (the temperature of liquid nitrogen) to 600 degrees C. Such deformation may serve several purposes and, in particular, it may help in transforming undesirable nonmagnetic gamma or epsilon phases to a magnetic alpha-prime phase especially at high levels of Mn or Ni. Also, initial plastic deformation may enhance the kinetics of initial two-phase alpha-plus-gamma decomposition and help to produce uniform, fine scale, isotropic two-phase structure. At this point, particle size may typically be in the neighborhood of 3000 to 10,000 Angstrom. Initial deformation is preferably uniaxial, resulting in elongation in a preferred direction as, e.g., by rod rolling, extrusion, wire drawing, or less preferably, swaging; planar deformation such as, e.g., by cold rolling leads to inferior properties. If deformation is carried out at a temperature above room temperature, the alloy may subsequently be air cooled or water quenched.

Heat treatment after initial deformation is preferably effected at temperatures corresponding to an alpha-plus-gamma two-phase state of the alloy; particularly suited are temperatures in the general range of 400–650 degrees C. Duration of such heat treatment is preferably at least 30 minutes. Subsequent cooling to a temperature near or below room temperature may result in transformation of gamma phase partially or totally to alpha prime or epsilon phase.

Isotropic grains and fine scale structure produced upon two-phase decomposition are subsequently deformed, preferably uniaxially such as, e.g., by wire drawing, rod drawing, swaging, or extruding. As compared with swaging, wire drawing was found to result in superior magnetic properties. As with initial plastic deformation described above, planar deformation such as, e.g., by rolling leads to inferior properties. Deformation may be effected at room temperature or at any temperature in the range from −196 to 600 degrees C. Preferred amounts of deformation correspond to an area reduction of at least 80 percent and preferably at least 95 percent, ductility adequate for such deformation being assured by limiting the presence of impurities and, in particular, of elements of groups 4b and 5b of the periodic table such as Ti, Zr, Hf, V, Nb, and Ta. After deformation, saturation magnetization $B_s$(gauss) of the alloy is typically greater than or equal to a value of $20{,}000-200\times$ weight percent Ni$-400\times$weight percent Mn.

Figure 2:
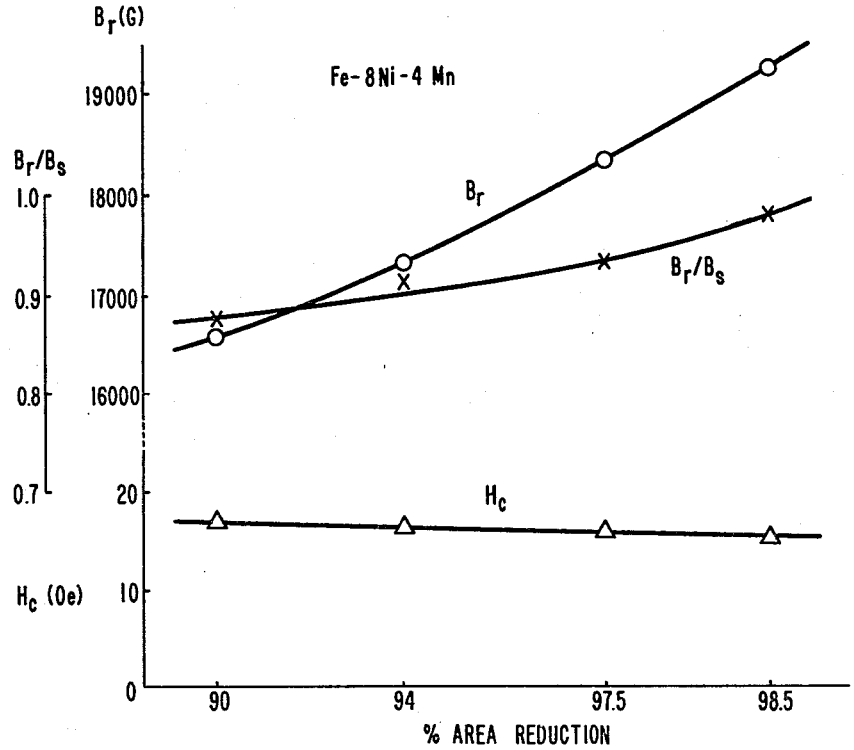
FIG. 2 shows magnetic properties of an Fe-8Ni-4Mn alloy as a function of cross-sectional area reduction by wire drawing.

Ultimate magnetic properties improve as the amount of deformation is increased; this is illustrated in FIG. 1 for an Fe-Ni alloy comprising 12 weight percent Ni and in FIG. 2 for an Fe-Ni-Mn alloy comprising 8 weight percent Ni and 4 weight percent Mn. Calculated aspect ratio is defined as grain length divided by grain diameter. Alloys of the invention remain high ductile even after severe deformation such as, e.g., by cold wire drawing resulting in 95 percent area reduction. Such deformed alloys may be further shaped, e.g., by bending or flattening without risk of splitting or cracking. Bending may produce a change of direction of up to 30 degrees with bend radius not exceeding thickness. For bending through larger angles, safe bend radius may increase linearly to a value of 4 times thickness for a change of direction of 90 degrees. Flattening may produce a change of width-to-thickness ratio of at least a factor of 2.

Figure 3:
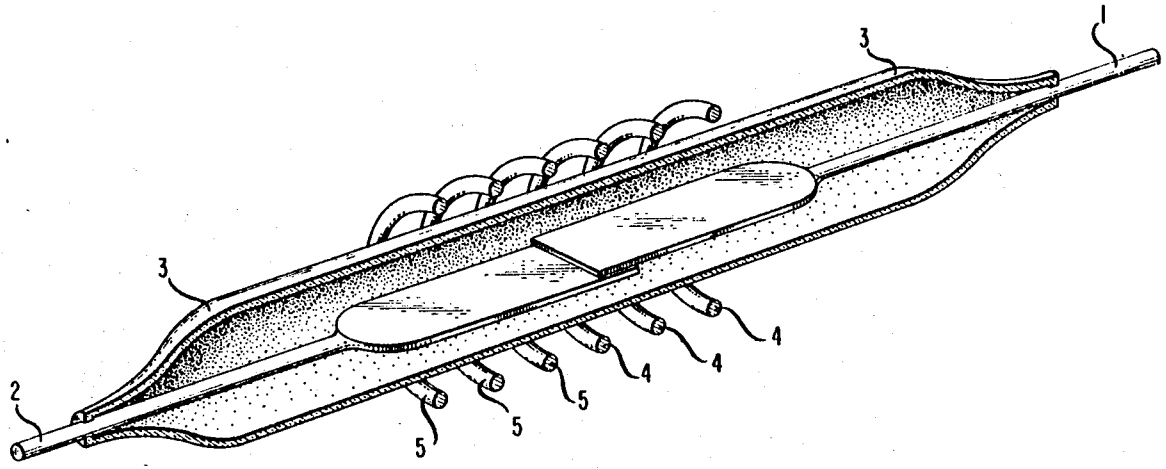
FIG. 3 shows a reed switch assembly comprising reeds made of a magnetically semihard alloy.

High formability in the wire-drawn state is of particular advantage in the manufacture of devices such as reed switches exemplified in FIG. 3 which shows reeds 1 and 2 made of an alloy of the invention and extending through glass encapsulation 3 which is inside magnetic coils 4 and 5. Formability is enhanced by minimization of the presence of impurities and, in particular, of elements of groups 4b and 5b of the periodic table such as Ti, Zr, Hf, V, Nb and Ta.

After plastic deformation of a multiphase structure, a final low temperature aging heat treatment within an alpha-plus-gamma two-phase region is given, preferably at a temperature which is less than or equal to the temperature used for initial aging. Typical aging temperatures are in the range of 350–500 degrees C. depending on Ni and Mn contents, and aging time is preferably in the range of from 10 minutes to 4 hours. Final aging enhances squareness $B_r/B_s$ of the B-H loop as may be due to one or several of metallurgical effects such as, e.g., relief of internal stress caused by deformation. Squareness may also be enhanced by partial or total reverse martensitic transformation of an (Ni, Mn)-rich phase which was formed during initial isothermal decomposition in an alpha-plus-gamma region and which subsequently was transformed partially or fully to magnetic alpha-prime phase in the course of final deformation. Furthermore, enhanced squareness may be due to the presence of nonmagnetic or weakly magnetic gamma or epsilon phases that may serve as a desirable barrier for the demagnetization process, or to formation of a thin layer of nonmagnetic or weakly mangetic gamma phase having higher Mn content along the grain boundaries of the elongated two-phase structure. Rate of cooling to room temperature after annealing or aging heat treatments is not critical; either air cooling or water quenching may be used. An alternate effective method as distinguished from a method comprising steps (1)–(4) described above, consists in replacing combined steps (1) and (2) by the following steps of thermal cycling; aging in an essentially two-phase alpha-plus-gamma range, cooling to room temperature, annealing in an essentially single phase gamma range, cooling to room temperature, aging in an essentially two-phase alpha-plus-gamma range, and cooling to room temperature. Such alternate method produces fine-scale, essentially isotropic two-phase structure through thermal cycling alone and without initial deformation; this is particularly advantageous in the processing, e.g., of heavy sections of wire or rods. Following thermal cycling, processing continues as described above in steps (3) and (4).

Among benefits of Fe-Ni and Fe-Ni-Mn semihard alloys according to the invention are the following: (1) high magnetic squareness as is desirable in switching and other magnetically actuated devices, (2) abundance and low cost of constituent elements Fe, Ni, and Mn, (3) ease of processing and forming due to high formability and ductility even after final aging, (4) low magnetostriction as may be specified by a saturation magnetostriction coefficient not exceeding $15\times10^{-6}$ as may be desirable, e.g., to prevent sticking of reed contacts, and (5) ease of plating with contact metal such as gold.

EXAMPLE 1

An Fe-12Ni alloy sample was prepared from a cast ingot by hot rolling, cold rolling, and cold shaping into a 0.265 inch diameter rod. The sample was annealed at a temperature of 900 degrees C. for 30 minutes, air cooled, swaged to 0.1 inch diameter (corresponding to 86 percent area reduction), aged at a temperature of 550 degrees C. for 18 hours, wire drawn to 20 mil diameter (corresponding to 96 percent area reduction), and aged at a temperature of 500 degrees C. for 30 minutes. Magnetic properties were measured as follows: $B_r=17{,}400$ gauss, $H_c=6$ oerested, and $B_r/B_s=0.94$.

EXAMPLE 2

An Fe-8Ni-4Mn alloy sample was prepared from a cast ingot by hot rolling, cold rolling, and cold shaping into a 0.265 inch diameter rod. The sample was annealed at a temperature of 900 degrees C. for 75 minutes, air cooled, wire drawn to 0.125 inch diameter (corresponding to an area reduction of 78 percent), aged at a temperature of 550 degrees C. for 4 hours, wire drawn to 20 mil diameter (corresponding to 97.5 percent area reduction), and aged at a temperature of 450 degrees C. for 30 minutes. Magnetic properties were measured as follows: $B_r=18{,}400$ gauss, $H_c=16$ oersted, and $B_r/B_s=0.93$.

EXAMPLE 3

An Fe-11Ni-4Mn alloy sample was prepared from a cast ingot by hot rolling, cold rolling, and cold shaping into a 0.265 diameter rod. The sample was annealed at a temperature of 900 degrees C. for 30 minutes, air cooled, wire drawn to 0.125 inch diameter (corresponding to 78 percent area reduction), aged at a temperature of 600 degrees C. for 4 hours, wire drawn to 15 mil diameter (corresponding to 98.5 percent area reduction), and aged at a temperature of 500 degrees C. for 30 minutes. Magnetic properties were measured as follows: $B_r=16{,}000$ gauss, $H_c=32$ oersted, $B_r/B_s=0.99$.

EXAMPLE 4

An Fe-11Ni-4Mn alloy sample was prepared from a cast ingot by hot rolling, cold rolling, and cold shaping into a 0.265 diameter rod. The sample was annealed at a temperature of 900 degrees C. for 30 minutes, air cooled, wire drawn to 0.125 inch diameter (corresponding to 78 percent area reduction), aged at a temperature of 550 degrees C. for 4 hours, wire drawn to 15 mil diameter (corresponding to 98.5 percent area reduction), and aged at a temperature of 450 degrees C. for 30 minutes. Magnetic properties were measured as follows: $B_r=19{,}200$ gauss, $H_c=21$ oersted, $B_r/B_s=0.99$.

I claim:

1. Method for making a magnetic element consisting essentially of a body of a metallic alloy having a magnetic squareness ratio which is greater than 0.7 and having remanent magnetic induction which is greater than 7000 gauss, said method being characterized by the steps of (1) plastically deforming a metallic body consisting essentially of an alloy comprising an amount of at least 98 weight percent, Fe, Ni, and Mn, Ni being in the range of 6–20 weight percent of said amount, and Mn being less than or equal to 8 weight percent of said amount, deforming being by uniaxial elongation by an amount corresponding to an area reduction which is greater than or equal to 50 percent, (2) aging said body at a temperature corresponding to an essentially two-phase state of said alloy, (3) plasticially deforming said body by uniaxial elongation by an amount corresponding to an area reduction which is greater than or equal to 80 percent, and (4) aging said body at a temperature corresponding to an essentially two-phase state of said alloy.

2. Method of claim 1 in which step (1) is effected by plastically deforming at a temperature in the range of −196 to 600 degrees C.

3. Method of claim 2 in which step (1) is effected by plastically deforming at a temperature which is higher than room temperature, followed by cooling said body.

4. Method of claim 1 in which step (2) is effected by aging at a temperature in the range of 400 to 600 degrees C. for a duration of at least 30 minutes.

5. Method of claim 1 in which step (3) is effected by plastically deforming at a temperature in the range of −196 to 600 degrees C.

6. Method of claim 1 in which step (3) is effected by plastically deforming by an amount corresponding to at least 95 percent area reduction.

7. Method of claim 1 in which step (4) is effected by aging at a temperature in the range of 350 to 500 degrees C. for a time of at least 10 minutes.

8. Method for making a magnetic element consisting essentially of a body of a metallic alloy having a magnetic squareness ratio which is greater than 0.7 and having remanent magnetic induction which is greater than 7000 gauss, said method being characterized by the steps of (1) aging a metallic body consisting essentially of an alloy comprising an amount of at least 98 weight percent Fe, Ni, and Mn, Ni being in the range of 6–20 weight percent of said amount, and Mn being less than or equal to 8 weight percent of said amount, aging being at a temperature corresponding to an essentially two-phase state of said alloy, (2) cooling said body to room temperature, (3) annealing said body at a temperature corresponding to an essentially single-phase state of said alloy, (4) cooling to room temperature, (5) aging said body at a temperature corresponding to an essentially two-phase state of said alloy, (6) cooling to room temperature, (7) plastically deforming said body by uniaxial elongation by an amount corresponding to an area reduction which is greater than or equal to 80 percent, and (8) aging said body at a temperature corresponding to an essentially two-phase state of said alloy.

* * * * *